US006167897B1

(12) United States Patent
Resso et al.

(10) Patent No.: US 6,167,897 B1
(45) Date of Patent: Jan. 2, 2001

(54) EXPANDABLE METAL CANOPY

(75) Inventors: Frank Resso; Dale Reagan, both of Tucker, GA (US)

(73) Assignee: Innovative Metals Company, Inc., Tucker, GA (US)

( * ) Notice: Under 35 U.S.C. 154(b), the term of this patent shall be extended for 0 days.

(21) Appl. No.: 09/283,526

(22) Filed: Apr. 1, 1999

(51) Int. Cl.[7] ..... E04H 15/34
(52) U.S. Cl. ..... 135/121; 52/73; 52/74
(58) Field of Search ..... 135/121, 122; 52/73–75, 76–78

(56) References Cited

U.S. PATENT DOCUMENTS 4,100,703 * 7/1978 Sickler ..... 52/16
4,561,227 * 12/1985 Asutin ..... 52/226
5,148,640 * 9/1992 Reilly ..... 52/74
6,044,593 * 4/2000 Puls ..... 52/74

* cited by examiner

*Primary Examiner*—Beth A. Stephan
(74) *Attorney, Agent, or Firm*—Oldham & Oldham Co., L.P.A.

(57) ABSTRACT

A metal canopy for a structure has an expansion strut which is directly affixed to a wall of the structure and at least one panel assembly for attachment to the expansion strut. More than one of the expansion struts may be affixed to the wall in abutting relationship to lengthen the span of the canopy. The expansion strut has flanges around its edges for attachment of the panel assembly or assemblies. A plurality of outwardly angled tabs are also positioned on the strut. Each of the panel assemblies has at least two panels, each of which has an upwardly extending flange along each of its sides, with adjacent panels aligned with corresponding flanges in abutting relationship. The panel assembly also has first and second end pieces affixed to an outside edge of the panel assembly along the outside edge of the outermost panels, with the end pieces having a bottom edge and a side edge. A trim strip is affixed to the bottom edge of the at least two panels and a seam cap is affixed atop the abutted flanges internal to the panel assembly. When the flange along the top edge of the panel assembly is inserted into and affixed to the top edge flange of the expansion strut, the bottom edge of the end pieces seats atop the bottom edge flange of the expansion strut, the outwardly angled tabs support the panels from below and the side edge of the end pieces bears against the expansion strut and may be affixed to the side edge flange thereon.

14 Claims, 6 Drawing Sheets

EXPANDABLE METAL CANOPY

The present invention relates to an all-metal canopy comprising factory formed component parts which are pre-assembled at the factory into modular units for field construction. These units allow multi-unit installation and field expansion. The canopy utilizes an interlocking connection between a canopy panel and a expansion strut used in the canopy which allows simple installation, provides a structural moment resistant connection and accurately controls the placement of the panel on the expansion strut.

BACKGROUND OF THE ART

In providing a canopy for a structure, building owners, designers, architects and the like have had fabric covered frameworks available. However, such fabric covered frameworks (as well as some of the generally rigid polymer coverings) which have been available fail to provide adequate long term protection from the elements. For example, they provide little or no resistance to high winds and snow and ice load. They tend to be vulnerable to degradation from ultraviolet (UV) light and mildew. Many of these are custom designed, so future expansion of the canopy without entire replacement of the fabric or polymer covering is not possible and there is often a high level of skill required to properly install the canopy, due to the complexity of the components and the stretching and fitting of the covering materials. These canopies as known in the prior art often have a useful life in the range of 5 to 12 years, provided, of course, that there is no premature failure due to a wind or snow load catastrophe.

As an alternative, the use of metal cladding, including standing seam roof panels, has become more popular. Although metal cladding provides a better life expectancy than cloth or polymer, they also significantly magnify the installation effort, to the extent that in many cases a professional roofing or renovation contractor is needed to install the system. Also, metal cladding systems typically do not come in a modular format, so the canopy must be fabricated on site. This necessarily means that the experience and craftsmanship of the individual installer becomes paramount, and it is difficult to expand, alter or even duplicate a canopy once it is installed.

It is therefore an advantage of the present invention to provide the components for construction of a canopy, where the individual components are provided in modular units with some pre-assembly, so that the canopy may be easily installed and may be altered or expanded at some later time just as easily.

SUMMARY OF THE INVENTION

This advantage of the present invention is provided by a novel expandable metal canopy for a structure comprising an expansion strut and at least one panel assembly to be associated with the expansion strut at the point of installation. The expansion strut is directly adapted to be affixed to a wall of the structure. It has a flange along a top edge thereof, a flange along a pair of opposing side edges thereof, a flange along a lower edge thereof and a plurality of outwardly angled tabs along the strut. The at least one panel assembly comprises at least two panels. Each of the panels has an upwardly extending flange along each of its sides, with adjacent panels aligned with corresponding flanges in abutting relationship. First and second end pieces are affixed to an outside edge of the panel assembly along the outside edge of the outermost panels in the panel assembly. The end pieces having a bottom edge and a side edge. A trim strip is affixed to the bottom edge of the at least two said panels and a seam cap is affixed atop the abutted flanges internal to the panel assembly. When the flange along the top edge of each of the panel assemblies is inserted into and affixed to the top edge flange of the expansion strut, the bottom edge of the end pieces seats itself atop the bottom edge flange of the expansion strut, the outwardly angled tabs support the panels from below and the side edge of the end pieces bears laterally against the expansion strut and may be affixed to the side edge flange thereon.

In the preferred embodiments, the expansion strut and the panel assembly are formed from metal, particularly 16 gauge, grade A527 steel.

When viewed normal to the surface, the panels are preferably rectangular. While the preferred embodiment will have a planar upper surface for the panels, some embodiments will have convex upper surface, with the curvature occurring from the top edge to the bottom edge, rather than across the panel from side to side. In the preferred embodiment with a planar upper surface, the upper surface will be aligned at an angle of from about sixteen degrees to about thirty degrees from horizontal when the panel assembly is affixed to the expansion strut. When the convex upper surface is used, a chord drawn between the top and bottom edges will be aligned effectively with the horizontal at an inclination in the same range.

It is preferred to use a piece of end trim at each end of the canopy over the respective end pieces. It is also preferred to use a hold down cleat which runs across the at least two said panels parallel to the top edge flange, especially a hold down cleat having a flange formed on an upper portion thereof. In such an embodiment, a head trim strip is used to seal the panel assembly to the expansion strut along the top thereof, particularly one wherein the head strip has a front edge adapted to engage the upper flange of the hold down cleat and a rear edge which is adapted to be fastened to the top edge flange of the expansion strut. It is preferred to interpose a strip of a sealant tape between the top edge flange and the head trim strip.

BRIEF DESCRIPTION OF THE DRAWINGS

A better understanding of the present invention will be had when reference is made to the accompanying drawings, wherein identical parts are identified by identical reference numerals and wherein.

Detailed Description of the Present Invention

The present invention of an expandable metal canopy 10 will be best understood when the method of installing such a device is described. The expandable metal canopy 10 comprises at least one expansion strut unit, at least one panel assembly unit and a number of trim components, as will be further described.

Figure 1:
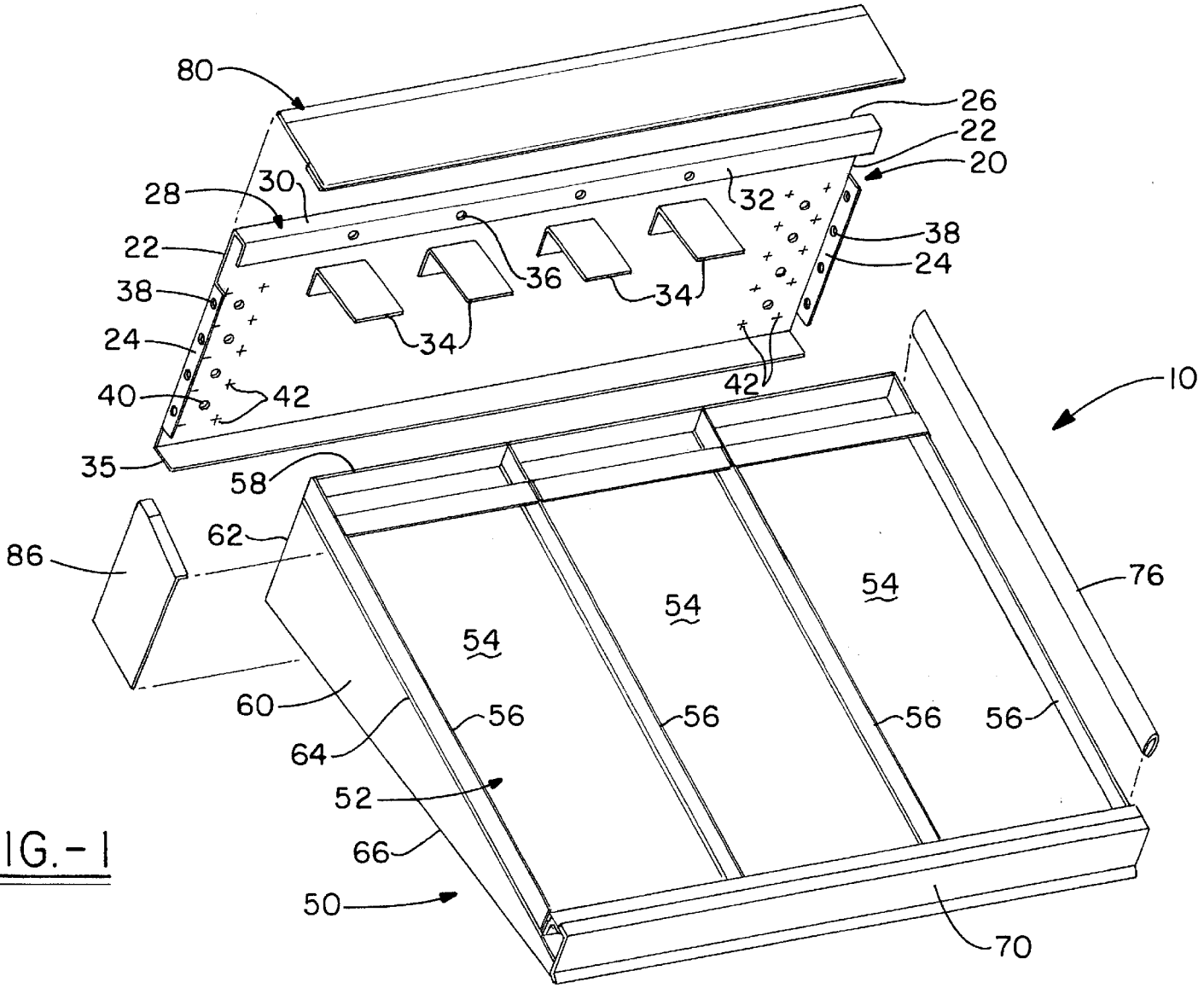
FIG. 1 shows an exploded perspective view of a first embodiment of the expandable metal canopy system of the present invention.

The first step for installing the expandable metal canopy 10 is to attach one or more of expansion struts 20 to the wall or structure to which the canopy will be attached. The expansion strut 20 of the present invention is shown in FIG. 1. The strut 20 is a generally planar rectangular sheet of metal, typically 16 gauge A527. In such an embodiment, the finished strut 20 will be about 28.75 inches wide by 13.25 inches tall. Each of the two side edges 22 has a flange portion 24, about 8 inches long, formed therealong, with each of the flange portions extending outwardly from the plane of the strut 20. A top edge 26 of the expansion strut 20 has an inverted "U" shaped flange 28 formed along its entire length. This inverted "U" shaped flange 28 has a base portion 30 which extends outwardly from the plane of the strut 20 for about 1.125 inches and a downwardly-extending arm 32 which also is about 1.125 inches long. The main body of the expansion strut constitutes the second arm of the inverted "U" shape flange 28. The bottom edge 35 of the expansion strut 20 is bent perpendicularly outwardly from the plane of the expansion strut for a distance of about 1.5 inches, effectively forming a shelf for receiving the panel portion of the expandable metal canopy of the present invention. A plurality of rectangular tabs 34 of the material comprising the expansion strut 20 are bent out of the plane of the strut such that an acute angle of about 74° is formed between the plane of the strut and the tab, or, described another way, the tabs 34 are about sixteen degrees from perpendicular to the plane of the expansion strut. As shown in FIG. 1, each of the tabs is about 4 inches long and about 4 inches wide. The tabs 34 are spaced evenly along the width of the expansion strut, with the second of the three tabs being centered along the width. In such an embodiment, the tabs 34 would be separated by about 4 inches. A hole or bore 36 through the downwardly extending arm 32 is centered with the center of each of the tabs 34. Each of the side flanges 24 is also provided with a number of holes 38, the holes 38 on the left and right side flanges being in alignment. The planar surface of the expansion strut 20 is also provided with a plurality of mounting holes 40.

To affix an expansion strut 20 of the invention as described to a wall, there must be at least 13.5 inches of free vertical space above the door or window for which a canopy is being provided. This space provides for the flush mounting of the expansion strut 20 onto the wall.

Multiple modules of the expandable metal canopy unit may be installed adjacent to each other, however, the present invention is best practiced by connecting no more than two expansion struts 20 to each other prior to installation on the wall. A first and a second expansion strut 20 are connected to each other by aligning the expansion struts along a side edge 22 of each so that a flange portion 24 of the first expansion strut is aligned with a flange portion 24 on the second expansion strut. Since each of the flange portions 24 has a plurality of holes 38, the holes on the respective flange portions may be aligned and the struts 20 connected by the use of conventional fasteners, the preferred fastener being a hex bolt with a complementary nut and a pair of flat washer, with one flat washer placed between the nut and one of the flange portions and the other flat washer positioned between the head of the bolt and the flange portion. If more than two expansion struts 20 are to be connected in a line, the struts should be connected in sections of two units, mounted to the wall and then connected to the adjacent units after mounting is complete.

The method of installing the expansion struts 20 to a wall depends upon the type of wall to be used.

If the wall is a stucco, wood, metal or vinyl exterior and the window or door has a wood or metal header beam, the expansion strut 20 should be properly centered and then made level, using conventional means. Using the expansion strut as a template, mark the outline of the expansion strut as well as the location of each mounting hole 40. Taking the expansion strut 20 away from the wall, use a small drill bit to pre-drill a hole at the marking for each mounting hole. Apply a strip of an appropriate sealant tape along the periphery of the rear side of the top and side edges of the expansion strut and apply the expansion strut onto the wall on the marks provided. Affix the expansion strut to the wall using fastening screws or other appropriate fasteners through the mounting holes 40 in the expansion strut. If the wall surface is uneven, textured or profiled (as in the case of lapped siding), the top and side edges of the expansion strut 20 should be sealed with a bead of an appropriate caulking material, such as a urethane sealant applied with a caulking gun. If the wall is a part of a metal building, the expansion strut should be secured to a beam of at least 18 gauge, a wall girt or metal studs. If necessary, longer screws should be used for proper fastening. Under no circumstance should the weight-bearing expansion strut be fastened only to exterior metal wall panel. When the expansion strut is being fastened to a trapezoidal or corrugated metal wall panel, it may be appropriate to use a foam closure to adequately seal the expansion strut to the wall. In such a case, the siding manufacturer's installation instructions should be consulted.

If the wall is a wood or metal stud framing with no header beam and a stucco, wood, metal or vinyl exterior, the locations of each wall stud should be found and marked. In marking, be sure that the stud may be easily and accurately located after the expansion strut 20 is in place. In other words, do not mark the studs in a manner which will be covered by the expansion strut. Failure to affix the weight-bearing expansion strut to the studs could result in collapse of the canopy and damage, injury or death. The expansion strut should be properly centered and then made level, using conventional means, to assure a true horizontal line. Using the expansion strut as a template, mark the outline of the expansion strut and the location of the mounting holes 42, which are the mounting holes located along the topmost row of the mounting holes 40. Taking the expansion strut 20 away from the wall, use a small drill bit to pre-drill a hole at the marking on the wall for each mounting hole 42. Apply a strip of an appropriate sealant tape along the periphery of the rear side of the top and side edges of the expansion strut and apply the expansion strut onto the wall on the marks provided. Affix the expansion strut 20 to the wall using fastening screws or other appropriate fasteners through the mounting holes 42 in the expansion strut, keeping in mind that this fastening is only temporary and not sufficient for support of the canopy. Referring to the stud locating markings, drill a plurality of holes through the expansion strut and into the studs and use the holes to fully secure the expansion strut to the wall. There should be at least five such holes for fastening per stud and there should be at least 2 inches between the adjacent fasteners. Each expansion strut should be fastened to at least two studs. If the wall surface is uneven, textured or profiled (as in the case of lapped siding), the top and side edges of the expansion strut 20 should be sealed with a bead of an appropriate caulking material, such as a urethane sealant applied with a caulking gun. If the wall is a part of a metal building, the expansion strut should be secured to a beam of at least 18 gauge, a wall girt or metal studs. If necessary, longer screws should be used for proper fastening. Under no circumstance should the weight-bearing expansion strut be fastened only to exterior metal wall panel. When the expansion strut is being fastened to a trapezoidal or corrugated metal wall panel, it may be appropriate to use a foam closure to adequately seal the expansion strut to the wall. In such a case, the siding manufacturer's installation instructions should be consulted.

If the wall is solid concrete, solid brick masonry or fully grouted (solid) concrete block, the expansion strut 20 should be properly centered and then made horizontally level, using conventional means. Using the expansion strut as a template, mark the outline of the expansion strut as well as the location of each mounting hole 40. Taking the expansion strut 20 away from the wall, use a drill bit to pre-drill pilot holes at the marking for each mounting hole, keeping in mind that these pilot holes must be deeper than the holes which would be used in a wood or metal wall. A rotary drill may be use in soft masonry; a hammer drill may be needed to drill into concrete or harder masonry walls. Apply a strip of an appropriate sealant tape along the periphery of the rear side of the top and side edges of the expansion strut and apply the expansion strut onto the wall on the marks provided. Affix the expansion strut to the wall using mounting screws or other appropriate fasteners through the mounting holes 40 in the expansion strut. If the wall surface is uneven, textured or profiled (as in the case of lapped siding), the top and side edges of the expansion strut 20 should be sealed with a bead of an appropriate caulking material, such as a urethane sealant applied with a caulking gun.

Figure 2:
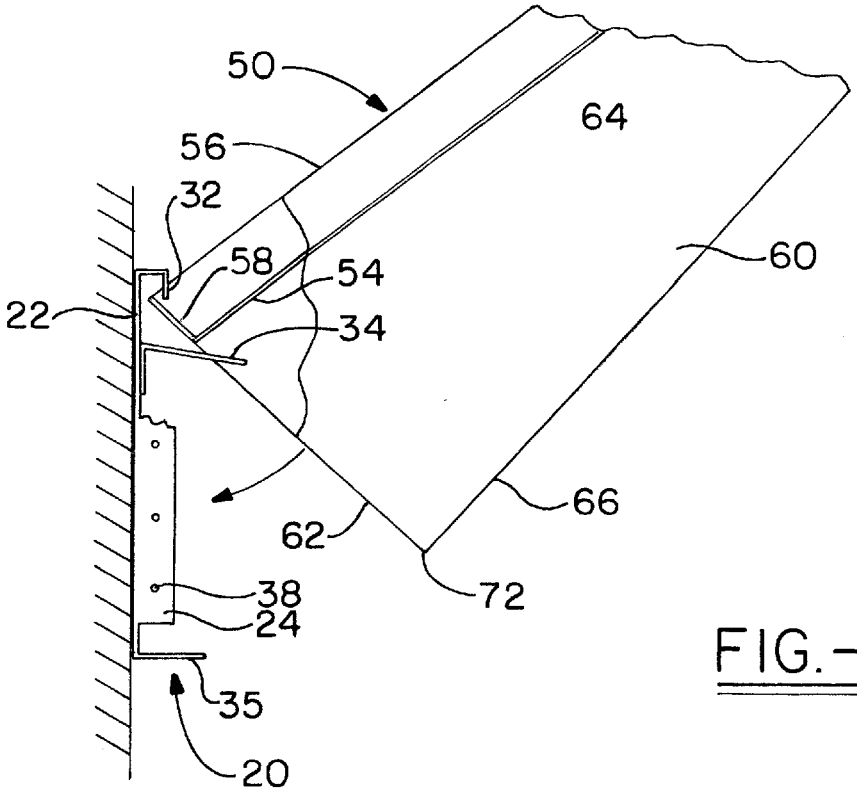
FIG. 2 shows a side view of the metal canopy being assembled.

Still referring to FIG. 2, features of the panel assembly 50 of the present invention are now disclosed. The panel assembly 50 comprises a generally planar portion 52 comprising at least two rectangular panels 54, although in some embodiments, there will be three panels. This latter situation is presented in FIG. 2. Each of the panels 54 used in the planar portion 52 has a raised flange 56 along each of its side edges. When two of the panels 54 are placed in abutting relationship along these raised flanges 56, a standing seam may be formed between the panels. A raised flange 58 is also formed along the top and bottom edges of each panel 54 and these end flanges are used in holding the panel assembly 50 into the expansion strut 20, as will be explained. The raised flanges 56 on the outermost side edges of each panel assembly 50 will not have an abutting raised flange from an adjacent panel 54, but a triangular end piece 60 is affixed along these outermost side edges. Each of the two triangular end pieces 60 is a right triangle, with the shortest side 62 of the end piece positioned at the top edge of the panel 54, and the hypotenuse edge 64 aligned along the raised flange 56. The third side 66 of the end piece 60 provides what will be a horizontally extending base for the panel assembly. This third side edge 66 has a bent flange 68 formed along it, with the flange extending inwardly relative to the panel portion 52 rather than outwardly therefrom. The raised flange 58 along the bottom edge of the panel assembly 50 has a trim strip 70 affixed therealong. Assembled in this manner, each panel assembly 50 provides a sloping roof surface which will constitute the covering portion of the canopy. The slope of the panel assembly 50 in this first embodiment will be about 16° relative to the horizontal, and in any case, the slope of the panel assembly will be substantially the same as the slope of the tabs 34 on the expansion strut 20.

Figure 3:
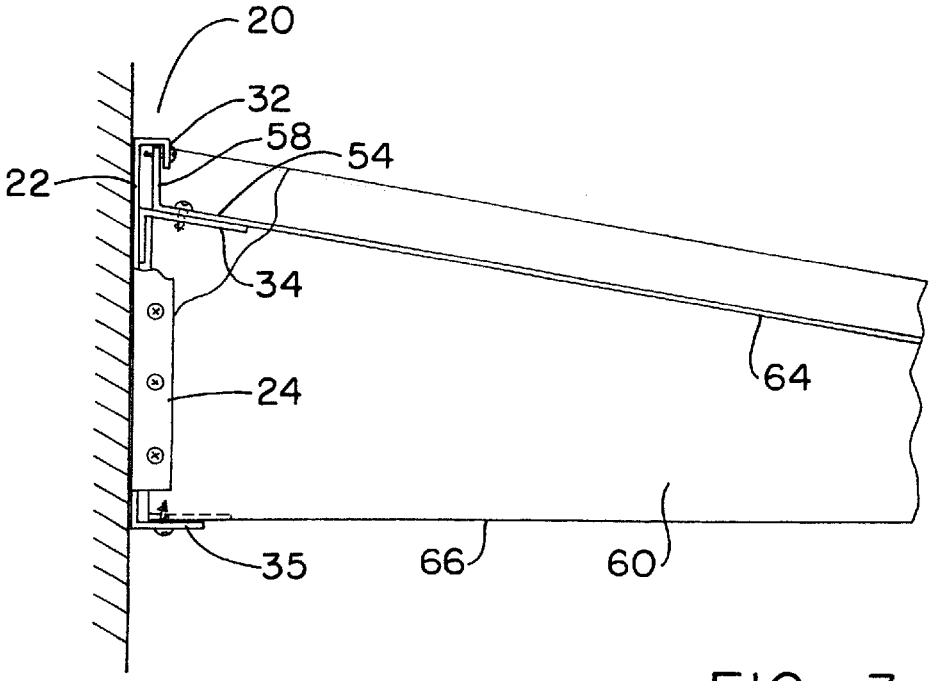
FIG. 3 shows a side view of the assembled metal canopy.

As shown in FIGS. 2 and 3, to assemble the expandable metal canopy 10 of the present invention, the top edge of a panel assembly 50 is inserted into the top of an expansion strut 20. When this occurs, the raised flange 58 along the top edge of the panel assembly will be positioned under downwardly extending arm 32 of the expansion strut and over the tabs 34. Viewing the juxtaposed raised flange 58 and downwardly extending arm 32 on the respective parts as a pivot point, the panel assembly 50 is rotated clockwise so that side edge 62 of each end piece 60 of the panel assembly aligns itself along the wall on which the expansion strut is mounted and the right angle corner 72 of each end piece 60 rests upon the shelf provided by the bottom edge 35 of the expansion strut. At this point, the inherent flexibility of the panel assembly 50 allows it to be precisely aligned to be plumb, level and square prior to being affixed to the expansion strut 20. The panel assembly 50 can rest temporarily in this position without being more permanently affixed, but it should not be relied upon to support any weight until it has been permanently affixed. The steps for permanently affixing are: fastening the top edge raised flange 58 to the downwardly extending arm 32 by a plurality of fasteners along the width of the panel assembly; fastening the planar portion 52 to the underlying tabs 34 with a plurality of fasteners along the width of the panel assembly 50; and fastening the flange 68 along the bottom of each end piece 60 to the bottom flange 35 of the expansion strut. In a preferred embodiment of the invention, pilot holes would be provided for these fasteners, which would preferably be sheet metal screws. This procedure of attaching the panel assemblies 50 to the corresponding expansion struts will be repeated for the entire width of the canopy to be erected, whether that is one expansion strut width or several.

Figure 4:
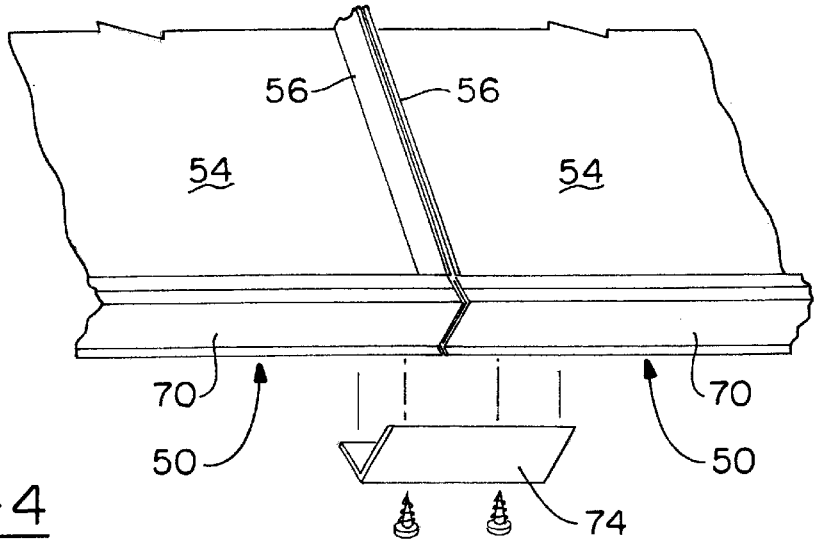
FIG. 4 shows an enlarged perspective view of two units being joined at the eave edge.

When more than one panel assembly 50 is used in a canopy, it is necessary to connect the adjacent panel assemblies. This is shown in FIG. 4. To do this, an eave splice 74 is used to vertically align the adjacent units at the lower or gutter edge of the panel assembly 50, where a metal screw is used to fasten the eave splice to the trim strip 70. Also, as shown in FIG. 1, a generally "U" shaped seam cap 76 is used along the adjacent raised flanges 56 on the outer edges of adjacent panel assemblies. The seam cap 76 is fitted onto the raised flanges 56 starting from the lower edge and moving toward the upper end. If the seam cap 76 is too tight, the opening between the arms of the "U" shape may be forced open slightly with a screw driver to ease the installation.

Figure 5:
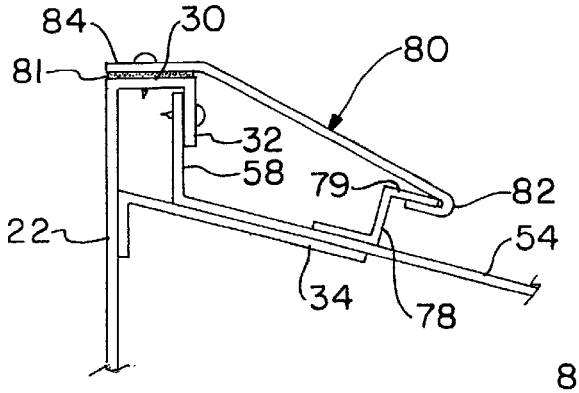
FIG. 5 shows an enlarged side view of the attachment of the head trim.

The next installation step takes place regardless of the number of adjacent panel assembly units. It is shown in FIG. 5. It is to seal the panel assembly 50 to the expansion strut 20 at the top edge junction using a head trim strip 80. First, a strip of sealant tape 81 is placed along the top edge of base portion 30. Each panel 54 of the panel assembly has a hold down cleat 78 affixed to it which runs parallel to the upper raised flange 58, so that the upper flange 79 thereof is positioned slightly higher than the raised flanges 56. A front edge 82 of the head trim strip 80 is slid into engagement with the upper flange 79 of the hold down cleat 78. A rear edge 84 of the head trim 80 is then screwed down onto the base portion 30 of the expansion strut atop the sealant tape. When multiple units are being attached in adjacent relationship, a head splice (not shown) would be used to connect adjacent head trim strips 80.

Figure 6:
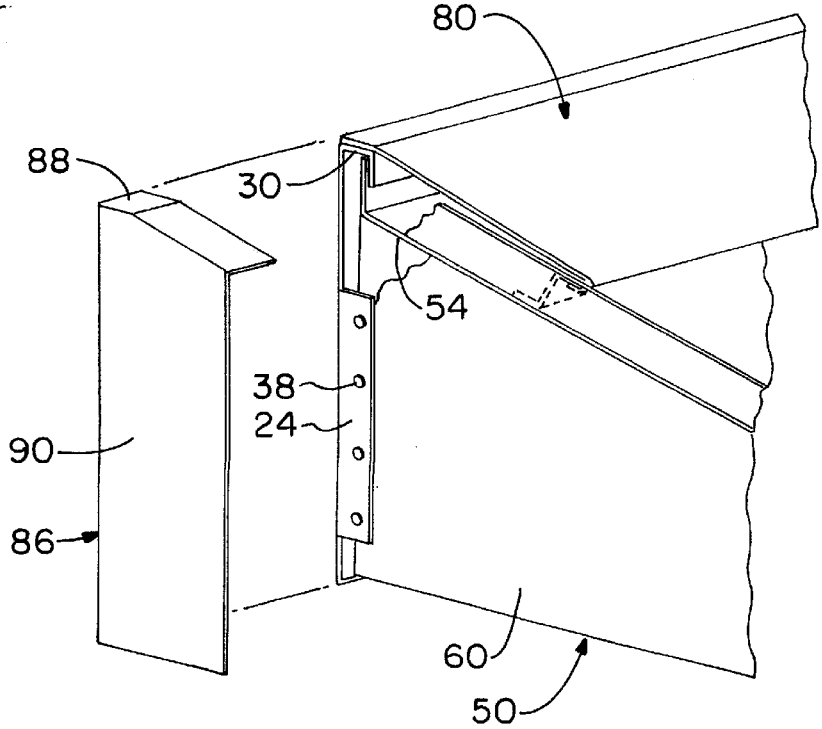
FIG. 6 shows a perspective view of the attachment of end trim.

Finally, as shown in FIG. 6, a piece of end trim 86 is secured to each end of the assembled canopy by sliding a slide tab 88 under the edge of the already installed head trim strip 80. The end trim 86 is then adjusted so that it fits tightly against the wall on which the expansion strut 20 is mounted. A metal screw passing through the rear edge 84 of the head trim, the slide tab 88 and the base portion 30 of the expansion strut, in that order, holds the slide tab into place. Two metal screws are then used to fasten the main body 90 of the end trim into the end piece 60 of the panel assembly. A bead of caulking, particularly a urethane type caulking, may be used to seal the joint between the end trim 86 and the wall.

Figure 7:
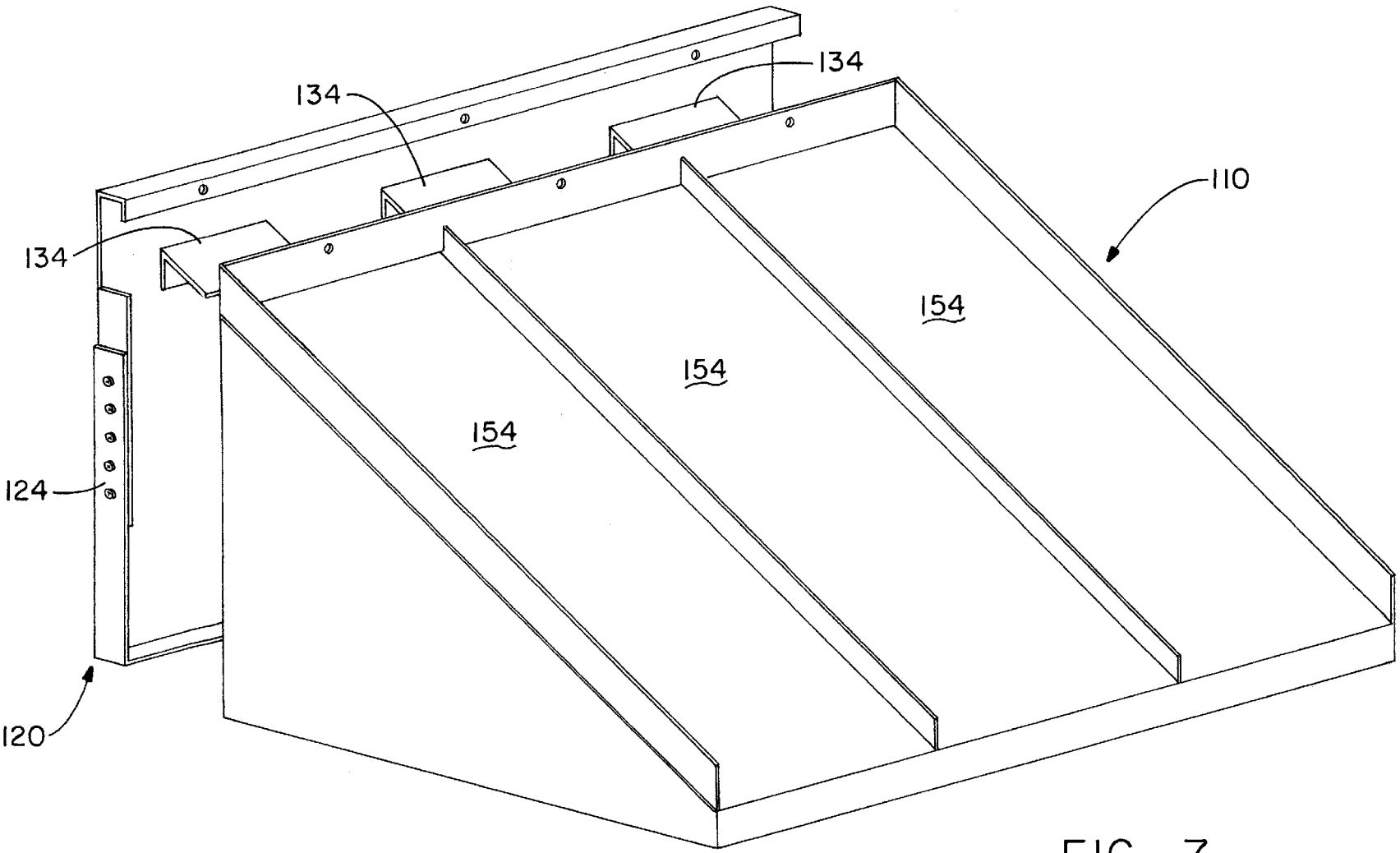
FIG. 7 shows an exploded perspective view of a second embodiment of the present invention.

Although the assembly of the present invention will be readily understood from the foregoing, the present invention is not limited only to the first embodiment presented. A second embodiment 110 of the present invention is presented in FIG. 7. In that depiction, the invention is shown in a "high slope" embodiment with the roof panels 154 effectively mounted at an angle of about 30°, measured from a horizontal line. Because the higher slope increases the vertical rise of the panel 154 for a given horizontal run, it will be preferred to make the expansion struts 120 taller and to extend the length of the flange portions 124 along the side edges of the expansion strut to allow for better mounting of the panels. The other change which will be made is to the tabs 134 which are bent out away from the expansion strut 20. Instead of forming an angle of about 74° with the vertical wall, the angle will be reduced to about 60°, which represents a corresponding angle to the 30° slope of the panel. Because of the taller height of the expansion strut 120 on the wall, it will of course be necessary to have a taller vertical free space on the wall for mounting of the device.

Figure 8:
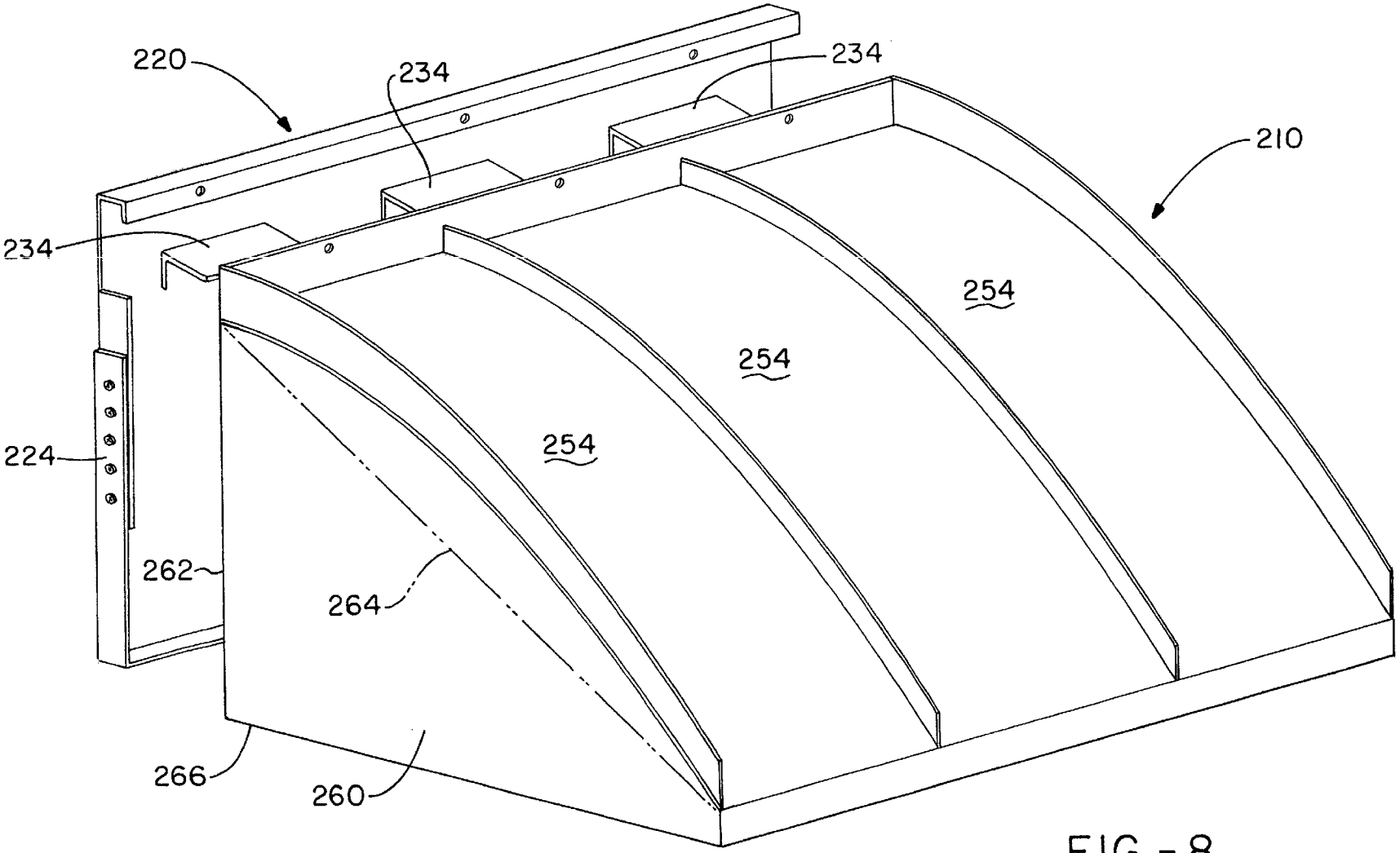
FIG. 8 shows an exploded perspective view of a third embodiment of the present invention.

A third embodiment 210 of the present invention is shown in FIG. 8, in which a low slope model as in the first embodiment is generally presented, however the panels 254 have a convex upper surface instead of a planar surface. This convex shape is defined by the shape of an arc segment subtending $2\alpha$ degrees of a complete circle, when the angle of a chord 264 of the arc segment is $\alpha$ degrees with respect to the horizontal. This chord 264 will be recognized as a line representing a hypotenuse of the right triangle defined by the sides 262, 266 of an end piece 260, which correspond to end piece 60 in the first embodiment. Although not shown, it is clear from this depiction that the seam cap which would correspond to seam cap 76 in the first embodiment would have the same angularity to it as the convex shape.

Figure 9:
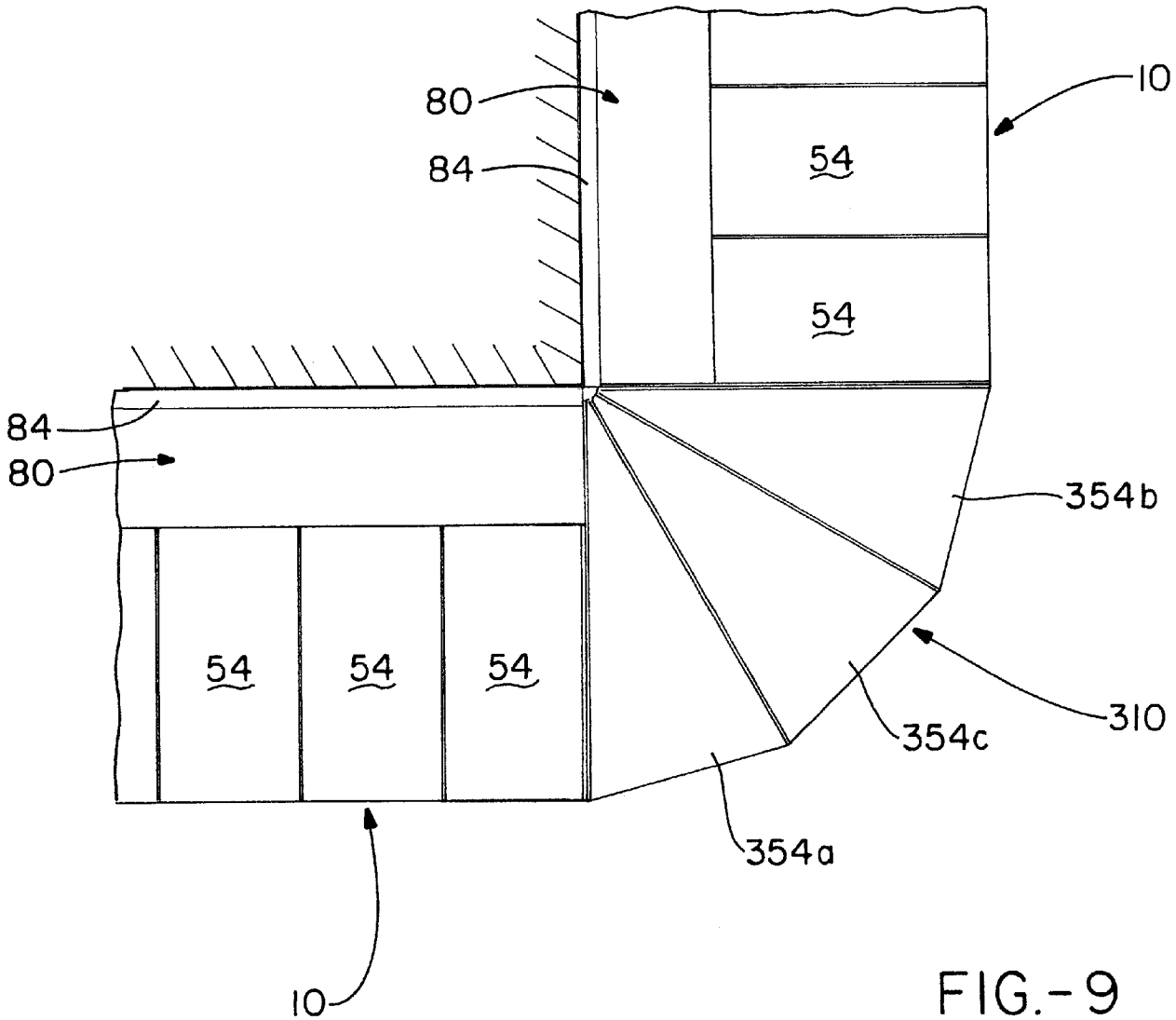
FIG. 9 shows a top plan view of an additional feature of the present invention.

A yet further feature of the present invention in shown in FIG. 9. In this figure, a device 310 and method is disclosed for "rounding off" a pair of canopies 10 of the present invention around an exterior corner of a structure. In this embodiment, the preferred manner of rounding off is to use three "pie" or wedge shaped panels 354*a*, 354*b*, 354*c*, each subtending an angle of about 30° of the 90° corner. The first of the wedge shaped panels 354*a* is attached on one side to the first straight run of the panels and the second 354*b* of the wedge shaped panels is attached to the second straight run, with a third wedge shaped panel 354*c* being attached along its side edges to the respective first and second wedge shaped panels, in the same manner as has been taught above for joining adjacent panels. Structurally, the three wedge shaped panels 354 are preferably interchangeable with each other at the construction site, so that no special care is required to select the proper one for the position. This last device 310 would not have an expansion strut, such as 20, associated directly with it, as it would rely upon the expansion struts 20 applied along the straight walls of the adjacent straight panel sections to which it is attached. Also, although the panels 354 are shown in FIG. 9 as having planar upper surfaces of the type shown with the first embodiment 10, the upper surfaces could just as easily have the convex upper surface of the type shown in embodiment 210 if the corner assembly is being attached to a pair of such canopies.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A canopy for a structure, comprising:

an expansion strut directly adapted to be affixed to a wall of the structure, the expansion strut having a flange along a top edge thereof, a flange along a pair of opposing side edges thereof, a flange along a lower edge thereof and a plurality of outwardly angled tabs along the strut; and at least one panel assembly comprising: at least two panels, each of the panels having a bottom edge, a top edge and a pair of side edges with an upwardly extending flange along each of the edges, with adjacent panels aligned with corresponding flanges in abutting relationship, with the panels lacking an adjacent panel on one side edge defining an outermost panel and the side edge lacking an adjacent panel defining an outside edge of the panel;

a first and a second end piece affixed to an outside edge of the panel assembly along the outside edge of the outermost panels, said first and second end pieces each having a bottom edge and a side edge; a trim strip affixed to the bottom edge of said at least two panels and a seam cap affixed atop the abutted flanges internal to the panel assembly;

such that when the flange along the top edge of the panel assembly is inserted into and affixed to the top edge flange of the expansion strut, the bottom edge of the end pieces seats atop the bottom edge flange of the expansion strut, the outwardly angled tabs support the panels from below and the side edge of the end pieces bears against the expansion strut and may be affixed to the side edge flange thereon.

2. The canopy of claim 1 wherein the expansion strut and the panel assembly are formed from metal.

3. The canopy of claim 2 wherein the metal is 16 gauge, grade A527 steel.

4. The canopy of claim 1 wherein the at least two said panels are rectangular.

5. The canopy of claim 4 wherein the at least two said panels have a planar upper surface.

6. The canopy of claim 4 wherein the at least two said panels have a convex upper surface, curving from the top edge to the bottom edge.

7. The canopy of claim 5 wherein the upper surface of the at least two said panels is aligned at an angle of from about sixteen degrees to about thirty degrees from horizontal when the panel assembly is affixed to the expansion strut.

8. The canopy of claim 1 wherein a piece of end trim is affixed to each end of the canopy over the respective end pieces.

9. The canopy of claim 1 wherein the panel assembly further comprises a hold down cleat affixed to the at least two said panels parallel to the top edge flange.

10. The canopy of claim 9, wherein the hold down cleat has a flange formed on an upper portion thereof.

11. The canopy of claim 10 wherein a head trim strip is used to seal the panel assembly to the expansion strut along the top thereof.

12. The canopy of claim 11 wherein the head trim strip has a front edge adapted to engage the upper flange of the hold down cleat and a rear edge which is adapted to be fastened to the top edge flange of the expansion strut.

13. The canopy of claim 12 wherein a strip of a sealant tape is interposed between the top edge flange and the head trim strip.

14. A canopy for a structure having first and second exterior walls intersecting at a exterior conner, comprising:

first and second expansion struts directly adapted to be affixed to the respective first and second exterior walls with an end of the expansion strut positioned at the exterior corner, each said expansion strut having a flange along a top edge thereof, a flange along a pair of opposing side edges thereof, a flange along a lower edge thereof and a plurality of outwardly angled tabs along the strut; and at least one panel assembly for each of the first and second expansion struts, each said panel assembly comprising: at least two panels, each of the panels having a bottom edge, a top edge and a pair of side edges with an upwardly extending flange along each of the edges, with adjacent panels aligned with corresponding flanges in abutting relationship, with the panels lacking an adjacent panel on one side edge defining an outermost panel and the side edge lacking the adjacent panel defining an outside edge of the panel;

a first and a second end piece affixed to an outside edge of the panel assembly along the outside edge of the outermost panels, said first and second end pieces each having a bottom edge and a side edge; a trim strip affixed to the bottom edge of said at least two panels and a seam cap affixed atop the abutted flanges internal to the panel assembly;

such that when the flange along the top edge of the panel assembly is inserted into and affixed to the top edge flange of the expansion strut, the bottom edge of the end pieces seats atop the bottom edge flange of the expansion strut, the outwardly angled tabs support the panels from below and the side edge of the end pieces bears against the expansion strut and may be affixed to the side edge flange thereon; and a plurality of wedge shaped panels adapted to be connected to each other and to the panel assemblies affixed to the first and second expansion struts, each of the wedge shaped panels having a flange formed along each of the sides thereof, said side flanges adapted to be affixed to the adjacent panel when placed in abutting relationship thereto.

* * * * *